US007673622B2

(12) United States Patent
Kidman et al.

(10) Patent No.: US 7,673,622 B2
(45) Date of Patent: Mar. 9, 2010

(54) AIR FILTER, SECONDARY AIR CHARGING SYSTEM AND SEAL ARRANGEMENT FOR A SECONDARY AIR CHARGING SYSTEM

(75) Inventors: Beau Kidman, Kalamazoo, MI (US); Stuart Miller, St. Kalamazoo, MI (US)

(73) Assignee: Mann + Hummel GmbH, Ludwigsburg (DE)

( * ) Notice: Subject to any disclaimer, the term of this patent is extended or adjusted under 35 U.S.C. 154(b) by 301 days.

(21) Appl. No.: 11/545,550

(22) Filed: Oct. 11, 2006

(65) Prior Publication Data

US 2007/0089718 A1 Apr. 26, 2007

Related U.S. Application Data

(60) Provisional application No. 60/724,899, filed on Oct. 11, 2005.

(51) Int. Cl.
*F02B 23/00* (2006.01)

(52) U.S. Cl. ..... 123/585; 123/198 E; 55/385.3; 60/293

(58) Field of Classification Search ..... 123/585, 123/572, 41.86, 198 E, 327, 26, 699; 60/280, 60/289, 290, 293; 55/385.3, 495, 502, 385.2
See application file for complete search history.

(56) References Cited

U.S. PATENT DOCUMENTS

| | | | | |
|---|---|---|---|---|
| 3,589,108 | A * | 6/1971 | Dingel et al. | 55/482 |
| 3,906,724 | A * | 9/1975 | Yoshizaki | 60/305 |
| 6,094,909 | A | 8/2000 | Weber et al. | |
| 6,306,190 | B1 * | 10/2001 | Tsuruta et al. | 55/385.3 |
| 6,571,760 | B2 * | 6/2003 | Kallander | 123/184.47 |
| 6,612,275 | B2 * | 9/2003 | Immel et al. | 123/90.31 |
| 6,883,323 | B2 | 4/2005 | Hummel | |
| 7,122,067 | B2 * | 10/2006 | Prellwitz et al. | 55/385.3 |
| 7,165,536 | B2 * | 1/2007 | Kirk et al. | 123/519 |

* cited by examiner

*Primary Examiner*—Michael Cuff
*Assistant Examiner*—Hung Q Nguyen

(57) ABSTRACT

A seal arrangement for a secondary air charging system includes a seal sealing a gap between an intake opening of the secondary air charging system and a downstream surface of an air intake filter.

12 Claims, 1 Drawing Sheet

AIR FILTER, SECONDARY AIR CHARGING SYSTEM AND SEAL ARRANGEMENT FOR A SECONDARY AIR CHARGING SYSTEM

CROSS REFERENCE TO RELATED APPLICATIONS

This application claims priority from U.S. provisional patent application No. 60/724,899, filed Oct. 11, 2005, the entire disclosure of which is incorporated herein by reference.

FIELD OF THE INVENTION

The invention relates to an air filter, a secondary air charging system for an engine, such as an internal combustion engine, and a seal arrangement for a secondary air charging system.

BACKGROUND OF THE INVENTION

A main function of an automotive air intake system is to supply filtered air to the engine. In addition to that function, the air intake system is used, for example, also to supply filtered air for positive crankcase ventilation or to a secondary air charging system.

The secondary air charging system is used to supply air to an exhaust system of the engine to improve the oxidation of hydrocarbons and carbon monoxides in the exhaust gas. Each of U.S. Pat. Nos. 6,094,909 and 6,883,323 describes a secondary air charging system.

One problem associated with a current secondary air charging system is that it interferes with the operation of a mass air flow sensor, which is disposed downstream from the point at which filtered air is drawn from the air intake system to supply the secondary air charging system. The mass air flow sensor is used to measure the rate of air flow to the engine in the air intake system. Drawing filtered air from the air intake system to supply the secondary air charging system creates air turbulence in the air intake system, making it difficult for the mass air flow sensor to accurately measure air flow. It also increases the noise level in the sensor signal, making it difficult to calibrate the engine control module.

The current state of technology for overcoming this problem is to separate the air flow in the air intake system from the air flow to the secondary air charging system. To that end, a box is provided having one open side and five closed faces, and the open side of the box faces the downstream surface of the air intake system's air filter to receive filtered air. A conduit, such as a hose, is connected to the box so that filtered air can flow from the box to the rest of the secondary air charging system.

However, this arrangement has several problems. One of the problems is that the arrangement usually does not completely separate the air flow in the air intake system from the air flow to the secondary air charging system. The reason is that there is usually a gap between the open side of the box and the downstream surface of the filter medium. Although the parts can be made more precisely to reduce the gap, the gap cannot be completely eliminated due to the coarseness of the filter's downstream surface. And precisely-made parts tend to be more expensive and may be difficult to assemble. Furthermore, when the open side of the box is placed close to the downstream surface of the filter medium to reduce the gap, the open side of the box may damage the filter, causing leakage through the filter medium.

This gap allows air flow between the box and the air intake system. When the secondary air charging system is in operation, the pressure inside the box is much lower than the pressure in the air intake system. As a result, air is drawn from the air intake system to the secondary air charging system, causing turbulence in the air intake system. On the other hand, when the secondary air charging system is not in operation, the pressure in the box is higher, creating air flow from the box to the air intake system and causing turbulence in the air intake system. Furthermore, the on/off operations of the secondary air charging system cause abrupt flow changes between the box and the air intake system, also creating flow turbulence in the air intake system.

SUMMARY OF THE INVENTION

The present invention solves the problems associated with the prior art by providing a seal that seals the gap between the intake opening of a secondary air charging system and the downstream surface of an engine air intake filter medium. The seal prevents air flow between the air intake system and the secondary air charging system, reducing air turbulence in the air intake system. This allows the mass air flow sensor to measure more accurately the air flow through the air intake system, and makes it easier to calibrate the engine control module. The parts also don't need to be precisely made to reduce the gap.

In accordance with one aspect of the invention, a secondary air charging system includes an intake opening facing a downstream surface of a filter medium of an engine air intake system, and a seal arrangement sealing a gap between the intake opening and the downstream surface of the filter medium. In a preferred embodiment, the seal arrangement may be attached to the intake opening, to the downstream surface of the filter medium, or to both. The intake opening of secondary air charging system may have a circular or rectangular configuration.

In accordance with another aspect of the invention, a seal arrangement for a secondary air charging system includes a seal sealing a gap between the intake opening of the secondary air charging system and the downstream surface of a filter medium of an air intake system. In a preferred embodiment, the seal may be attached to the intake opening, to the downstream surface of the filter medium, or to both.

In accordance with a further aspect of the invention, a filter medium for an engine air intake system includes a downstream surface facing an intake opening of a secondary air charging system, and a seal arrangement sealing a gap between the intake opening and the downstream surface of the filter medium. In a preferred embodiment, the seal may be attached to the intake opening, to the downstream surface of the filter medium, or to both.

Other objects, advantages and novel features of the present invention will become apparent from the following detailed description of the invention when considered in conjunction with the accompanying drawings.

DESCRIPTION OF PREFERRED EMBODIMENTS

Figure 1:
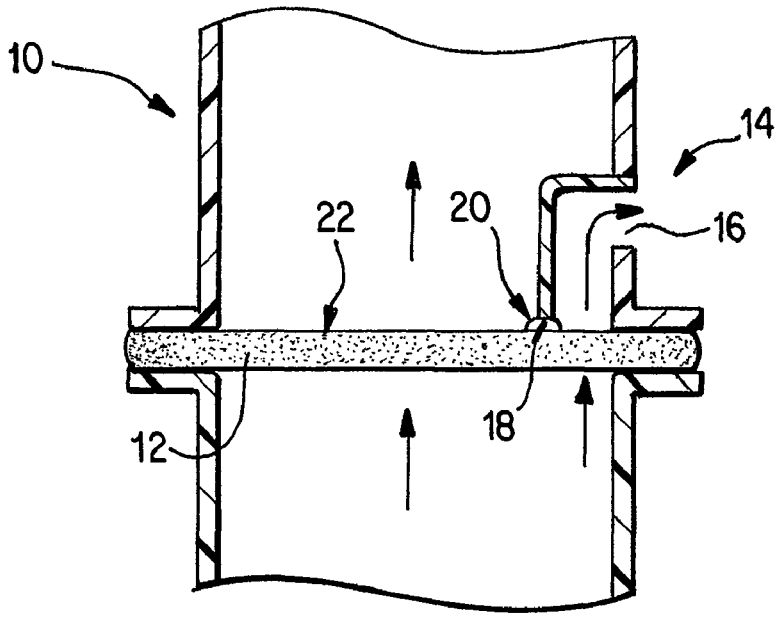
FIG. 1 is a cross-sectional view of a seal that seals the gap between the intake opening of a secondary air charging system and the downstream surface of an engine air intake filter in accordance with the present invention.

FIG. 1 illustrates an engine air intake system 10 having an air filter medium 12, a secondary air charging system 14 having an intake opening 16, and a seal 18 sealing a gap 20 between the intake opening 16 and the downstream surface 22 of the air filter medium 12. The seal 18 prevents air flow between the engine air intake system 10 and the secondary air charging system 14.

The intake opening 16 of the secondary air charging system 14 preferably faces the downstream surface 22 of the filter medium 12. And the intake opening 16 may have any suitable configuration. For example, it may have acircular or rectangular configuration.

Figure 2A:
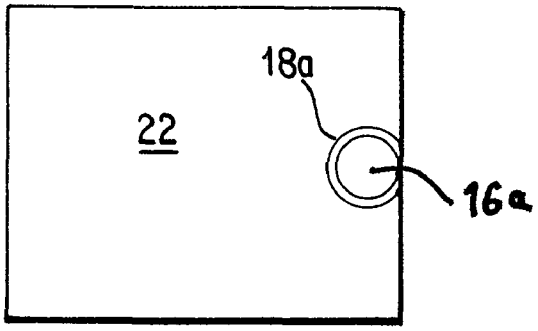
FIG. 2*a* is a view of the downstream surface of an engine air intake filter with the seal of FIG. 1, where the seal has a circular configuration.
Figure 2B:
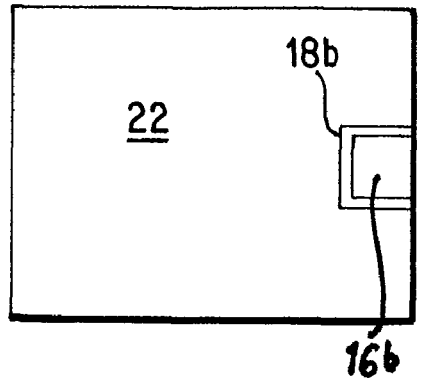
FIG. 2*b* is a view of the downstream surface of an engine air intake filter with the seal of FIG. 1, where the seal has a rectangular configuration.

The seal 18 may also have any suitable configuration. For example, it may have a circular configuration 18*a*, as shown in FIG. 2*a*, or a rectangular configuration 18*b*, as shown in FIG. 2*b*. The seal can be made from one or more of several suitable materials, including, for example, rubber and elastomer. Furthermore, the seal may be attached to the intake opening 16, to the downstream surface 22 of the air filter medium 12, or to both as shown in FIG. 1. The method of attachment may be, for example, adhesion, welding, molding, or mechanical attachment. Furthermore. FIG. 2*a* and FIG. 2*b* show the seal (18*a* and 18*b*) in full periphery contact with the downstream surface 22 of the air filter medium 12 (see FIG. 1). FIG. 1 illustrates that the seal 18 is disposed between the intake opening 16 and the downstream surface 22 of the air filter medium 12. As illustrated in FIGS. 1, 2*a* and 2*b*, the seal 18 is a single seal member.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A secondary air charging system comprising:

an Intake opening facing downstream surface of a filter medium of an engine air intake system, wherein the intake opening is used to receive filtered air from the filter medium;

a seal arrangement attached to the intake opening and sealing a gap between the intake opening and the downstream surface of the filter medium.

2. The secondary air charging system of claim 1, wherein the seal arrangement is attached to the downstream surface of the filter medium.

3. The secondary air charging system of claim 1, wherein the intake opening has a circular configuration.

4. The secondary air charging system of claim 1, wherein the intake opening has a rectangular configuration.

5. A seal arrangement for a secondary air charging system having an intake opening facing a downstream surface of a filter medium of an engine intake system, comprising:

a seal sealing a gap between the intake opening and the downstream surface of the filter medium, said air intake opening and seal in full periphery contact with said downstream surface of the said filter medium.

6. The seal arrangement of claim 5, wherein the seal is attached to the intake opening.

7. The seal arrangement of claim 6, wherein the seal arrangement is attached to the downstream surface of the filter medium.

8. The seal arrangement of claim 5, wherein the seal arrangement is attached to the downstream surface of the filter medium.

9. A filter medium for an engine air intake system, comprising: a downstream surface facing an intake opening of a secondary air charging system; and a seal arrangement sealing a gap between the intake opening and the downstream surface of the filter medium, wherein said seal arrangement is provided by a single seal member sealing between said intake opening and said downstream surface of said filter medium.

10. The filter of claim 9, wherein the seal arrangement is attached to the intake opening.

11. The seal arrangement of claim 10, wherein the seal arrangement is attached to the downstream surface of the filter medium.

12. The seal arrangement of claim 9, wherein the seal arrangement is attached to the downstream surface of the filter medium.

* * * * *